US008849167B2

(12) United States Patent
Kikuno

(10) Patent No.: US 8,849,167 B2
(45) Date of Patent: Sep. 30, 2014

(54) IMAGE FORMING APPARATUS

(75) Inventor: Mio Kikuno, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 13/154,092

(22) Filed: Jun. 6, 2011

(65) Prior Publication Data

US 2011/0305488 A1 Dec. 15, 2011

(30) Foreign Application Priority Data

Jun. 15, 2010 (JP) ..... 2010-136309

(51) Int. Cl.
*G03G 15/20* (2006.01)
*G03G 15/16* (2006.01)
*G03G 15/01* (2006.01)

(52) U.S. Cl.
CPC ..... *G03G 15/161* (2013.01); *G03G 15/0131* (2013.01)
USPC ..... 399/312

(58) Field of Classification Search
CPC ..... G03G 15/1685; G03G 15/0131; G03G 15/0161
USPC ..... 399/121, 126, 312
See application file for complete search history.

(56) References Cited

U.S. PATENT DOCUMENTS

| | | | | |
|---|---|---|---|---|
| 5,666,621 | A * | 9/1997 | Maekawa et al. | 399/303 |
| 2006/0115304 | A1* | 6/2006 | Ahn et al. | 399/303 |
| 2009/0279918 | A1* | 11/2009 | Sendo et al. | 399/121 |
| 2011/0103861 | A1* | 5/2011 | Kakehi | 399/400 |

FOREIGN PATENT DOCUMENTS

| | | | |
|---|---|---|---|
| JP | 03-062370 | U | 6/1991 |
| JP | 5-119636 | A | 5/1993 |
| JP | 5-341664 | A | 12/1993 |
| JP | 9-015987 | A | 1/1997 |
| JP | 11-024341 | A | 1/1999 |

OTHER PUBLICATIONS

Translation of Okubo (JP, 05-341664, A) listed in IDS, pub date: Dec. 24, 1993.*

* cited by examiner

*Primary Examiner* — Walter L Lindsay, Jr.
*Assistant Examiner* — Frederick Wenderoth
(74) *Attorney, Agent, or Firm* — Canon USA Inc IP Division

(57) ABSTRACT

An image forming apparatus includes an image bearing member, a movable belt member configured to bear and convey a recording medium, a transfer member, a lifting unit configured to lift the belt member on a downstream side of the transfer member in a conveying direction of the recording medium, from an inner surface side, so that a belt surface locally protrudes in a width direction of the belt member, and an execution unit configured to be capable of executing a mode for separating the recording medium by forming using the lifting unit a first protrusion having a first height in a vertical direction perpendicular to the belt surface that is not lifted, and a second protrusion higher than the first height at a position adjacent to the first protrusion in the width direction.

6 Claims, 13 Drawing Sheets

IMAGE FORMING APPARATUS

BACKGROUND OF THE INVENTION

1. Field of the Invention

The present invention relates to an image forming apparatus that transfers a toner image borne on an image bearing member onto a recording medium using an electrophotographic technology for a copying machine or a laser printer or the like. More particularly, the present invention relates to an image forming apparatus having a transfer belt that performs transfer of the toner image onto the recording medium, and conveyance of the recording medium.

2. Description of the Related Art

In an electrophotographic apparatus in which a recording medium is borne and conveyed by a transfer belt stretched by a plurality of rollers, a recording material on the transfer belt, when passing through a transfer nip portion, is electrostatically attracted to the transfer belt.

However, if a stiffness of a recording medium is weak, the recording medium cannot be separated from the transfer belt by only utilizing a curvature of a separation roller that stretches the transfer belt, and the stiffness of the recording medium. As a result, the recording medium remains attached to the transfer belt at a position of the separation roller, and thus an improper separation occurs.

Thus, as a configuration for providing undulations on a transfer belt at a separation position, there is a method for separating a recording medium by uniformly forming protruding objects on a surface of the separation roller that stretches the transfer belt, for example, as discussed in Japanese Patent Application Laid-Open No. 9-015987. Although undulations can be formed on the transfer belt at the separation position, by using such configuration, they will always cause a great tension to locally act on the transfer belt. As a result, transferability becomes unstable because of the effects of uneven resistance caused by occurrence of local wear of the transfer belt.

A method for reducing wear caused by deformation, even while causing a cylindrical-shaped transfer material bearing sheet that bears the recording medium to be deformed for separating the recording medium, is discussed in Japanese Patent Application Laid-Open No. 5-119636. In Japanese Patent Application Laid-Open No. 5-119636, there is discussed a configuration in which a roller is provided as a lifting means movable between a position at which a transfer sheet is lifted from an inner side and a position at which it is not lifted.

In a method discussed in Japanese Patent Application Laid-Open No. 5-119636, separation of the recording medium is performed by lifting the transfer sheet by using the roller, and the transfer sheet is not lifted as long as the recording medium is not separated. In order to separate recording media with different thicknesses without causing the transfer material sheet to be deformed more than necessary, a method for separating a thin recording medium by a large lifting amount, and separating a thick recording medium by a small lifting amount is discussed in Japanese Patent Application Laid-Open No. 5-341664.

By applying such configuration to the transfer belt, there is built a configuration for arranging a lifting means for performing an operation of locally lifting the transfer belt in a width direction of the transfer belt during separation step, on the downstream side in a recording medium conveying direction from a transfer member that transfers a toner image onto the recording medium on the transfer belt.

If a stiffness of a recording medium such as a thin paper sheet is weak, undulations can be formed on the recording medium by conveying the recording medium in a state where the transfer belt is locally lifted, and a stiffness of the recording medium during the separation step can be increased.

When a distance of protrusions formed on the transfer belt in a width direction is made larger, a region where it is hard to form undulations on the recording medium will be generated between adjacent protrusions. Thus, in order to restrain generation of the region where it is hard to form the undulations in the recording medium between adjacent protrusions, it is desirable to keep a distance between adjacent protrusions.

On the other hand, in order to make the stiffness of the recording medium greater, it is effective to make a lifting amount which the lifting means lifts the transfer belt greater, and to make protrusions to be formed on the transfer belt higher.

However, if the protrusions are made high, while keeping a distance between adjacent protrusions short, a valley shape formed between adjacent protrusions will become steeper and deeper. As a result, it becomes difficult for the recording medium to follow a bottom of the valley shape, and a distance between the recording medium and the transfer belt becomes large at the bottom, whereby there is a risk of deteriorating a toner image of the recording medium.

SUMMARY OF THE INVENTION

The present invention is directed to an image forming apparatus capable of restraining a toner image of a recording medium from being deteriorated, while retaining a distance between adjacent protrusions short.

According to an aspect of the present invention, an image forming apparatus includes an image bearing member configured to bear a toner image, a movable belt member configured to bear and convey a recording medium, a transfer member configured to electrostatically transfer the toner image formed on the image bearing member onto the recording medium borne and conveyed by the belt member, a lifting unit configured to lift the belt member on a downstream side of the transfer member in a conveying direction of the recording medium, from an inner surface side, so that a belt surface locally protrudes in a width direction of the belt member, and an execution unit configured to be capable of executing a mode for separating the recording medium by forming using the lifting unit a first protrusion having a first height in a vertical direction perpendicular to the belt surface that is not lifted, and a second protrusion higher than the first height at a position adjacent to the first protrusion in the width direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<Image Forming Apparatus>

Figure 1:
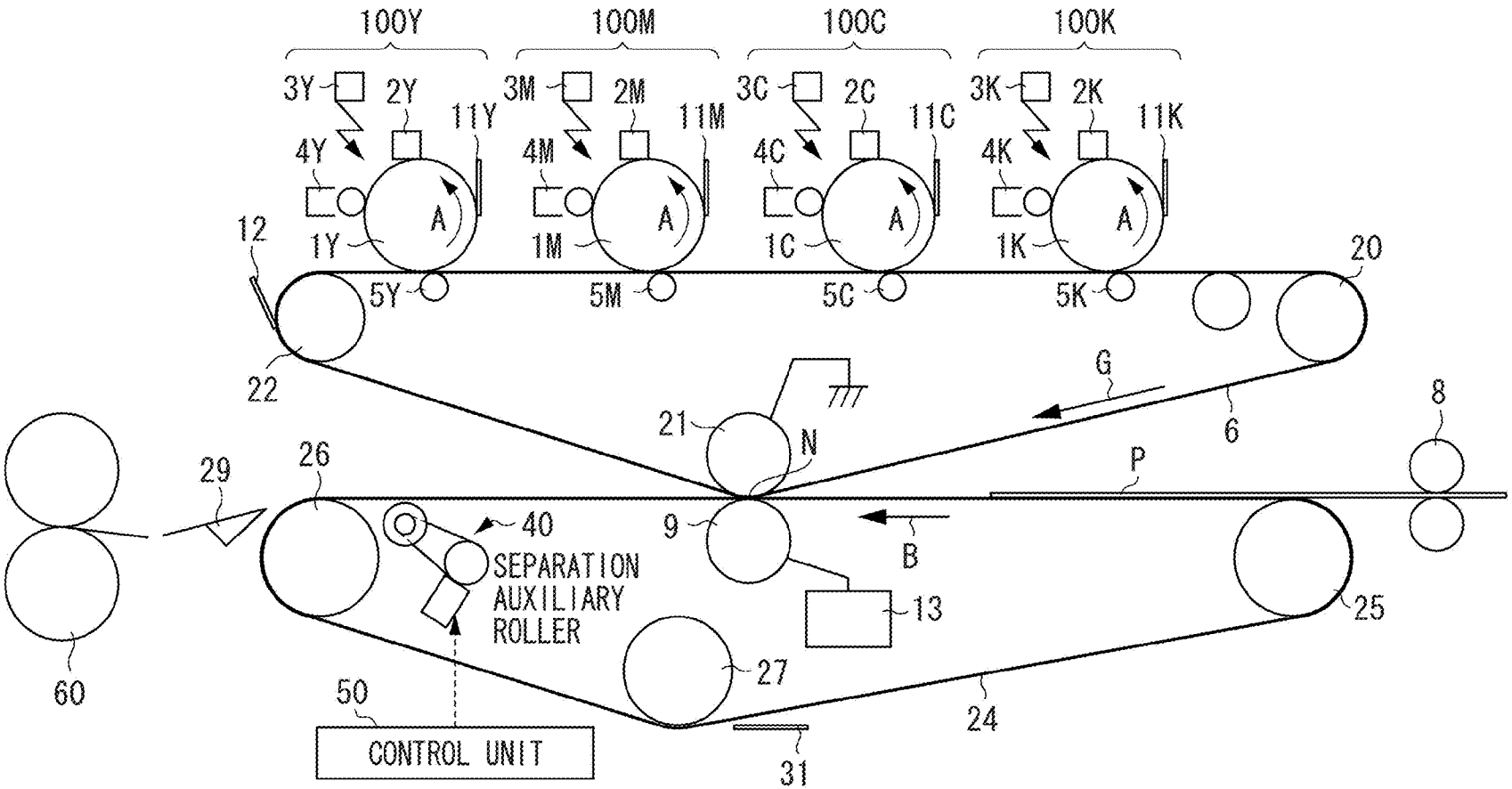
FIG. 1 illustrates a first exemplary embodiment.

An image forming apparatus according to the present invention will be described. First, the configuration and operation of the image forming apparatus will be described with reference to FIG. 1. The image forming apparatus illustrated in FIG. 1 is an image forming apparatus for colors using an electrophotographic method. FIG. 1 is a cross-sectional view of the image forming apparatus of what is called an intermediate transfer tandem system in which image forming units for four colors are arranged side by side over an intermediate transfer belt.

First, an image forming unit 100 will be described. In the present exemplary embodiment, the image forming unit 100 has well-known image forming units 100Y, 100M, 100C, and 100K. Next, respective image forming units will be described.

Photosensitive drums 1Y, 1M, 1C, and 1K each serve as an image bearing member rotatable in an arrow A direction. Charging devices 2Y, 2M, 2C, and 2K each serve to charge the respective photosensitive drums. Exposure devices 3Y, 3M, 3C, and 3K each image-expose the respective photosensitive drums based on input image information with light.

Developing devices 4Y, 4M, 4C, and 4K each form toner images on the respective photosensitive drums. The developing device 4Y develops an image using a toner yellow (Y), the developing device 4M develops an image using a toner of magenta (M), the developing device 4C develops an image using a toner of cyan (C), and the developing device 4K develops an image using a toner of black (K). Cleaning devices 11Y, 11M, 11C, and 11K each remove toners that have remained on the photosensitive drums after the transfer step.

Next, an intermediate transfer belt 6 serving as an intermediate transfer member or an image bearing member opposed to the respective photosensitive drums will be described. The intermediate transfer belt 6 is designed to be stretched by a plurality of stretching rollers 20, 21, and 22 serving as stretching members, and to rotate in an arrow G direction. In the present exemplary embodiment, the stretching roller 20 is a tension roller that provides tension to the intermediate transfer belt 6 so that the tension of the intermediate transfer belt 6 becomes constant.

The stretching roller 22 is a driving roller that transmits a driving force to the intermediate transfer belt 6, and the stretching roller 21 is an inner-side-opposed roller that forms a secondary transfer unit. In the inside of the intermediate transfer belt 6, there are provided primary transfer rollers 5Y, 5M, 5C, and 5K serving as primary transfer members for transferring toner images formed onto the respective photosensitive drums onto the intermediate transfer belt 6. With the above-described configuration, four-color toner images are transferred to be superposed onto the intermediate transfer belt 6, and are conveyed to the secondary transfer unit.

Next, a configuration of a secondary transfer portion N that transfers a toner image formed on the intermediate transfer belt 6 onto the recording medium will be described. The secondary transfer portion is formed by an inner-side-opposed roller 21 serving as a first transfer member provided on an inner surface of the intermediate transfer belt 6, via the intermediate transfer belt 6 and the transfer belt 24, and an outer-side-opposed roller 9 serving as a second transfer member that presses the inner-side-opposed roller 21 from an outer surface side of the intermediate transfer belt 6.

Further, a voltage reverse to the normal charging polarity is applied from a secondary transfer high-voltage power supply 13 to the outer-side-opposed roller 9, whereby the toner is transferred onto the recording medium. A conveying unit that conveys the recording medium will be described below.

The toner image formed on the intermediate transfer belt 6 is conveyed from a registration roller 8 to the transfer belt 24 at a predetermined timing, and is secondarily transferred onto the recording medium that has been conveyed to the secondary transfer unit.

Thereafter, a recording medium P is conveyed to a recording medium guide 29, and after that, is conveyed to a fixing device 60. The fixing device 60 exerts a predetermined amount of pressing force and heat within a fixing nip formed by a fixing roller 615 and a pressurizing roller 614 opposed to each other illustrated in FIG. 1, to cause the toner image to be fused and adhered to the recording medium.

<Configuration of Transfer Belt>

A transfer belt 24 serves as a movable belt member that bears and conveys the recording medium. The transfer belt 24 is stretched by a plurality of stretching rollers 25, 26, and 27 serving as stretching members, and rotates in an arrow B direction. In the present exemplary embodiment, the stretching roller 26 serves as a driving roller that transmits a driving force to the transfer belt 24. Also, the stretching rollers 25, 26, and 27 rotate driven by the rotation of the transfer belt 24. The stretching rollers 25, 26, and 27 each are cylindrical-shaped rollers.

The recording medium P conveyed from the registration roller 8 begins to abut against the transfer belt 24 at a belt surface of the stretching roller belt 25 provided on the upstream side of the secondary transfer portion N in a movement direction of the transfer belt 24. In the present exemplary embodiment, it is configured not to have an attracting means such as an attracting roller for causing the recording medium to be electrostatically attracted to the transfer belt 24. However, the recording medium P may be attracted to the transfer belt 24 using the attracting means.

The recording medium P placed on a surface of the transfer belt 24 on the upstream side of the secondary transfer portion N is conveyed to the secondary transfer portion N along with a movement of the transfer belt 24. After the toner image is transferred onto the recording medium at the secondary transfer portion N, the recording medium is separated from the transfer belt 24.

In the present exemplary embodiment, if a grammage of the recording medium is greater than a predetermined value, the recording medium P is separated from the transfer belt 24 by a curvature formed by the stretching roller 26, without the necessity of operating an auxiliary separation device 40 described below. In this way, the stretching roller 26 functions as a separating and stretching member capable of separating the recording medium carried on the transfer belt 24 from the transfer belt 24.

On the other hand, if a grammage of the recording medium is smaller than the predetermined value, the recording medium is separated from the transfer belt 24 by an operation of the auxiliary separation device 40 described below.

The transfer belt 24 according to the present exemplary embodiment is made of resins such as polyimide, or polycarbonate or various types of rubbers with an appropriate amount of carbon black being contained as an antistatic agent. Then, a transfer belt with its volume resistance of 1E+9 to 1E+14 [Ω–cm], and a thickness of 0.07 to 0.1 [mm] is used.

The transfer belt used herein is made of a elastic member with a value of Young's modulus of 0.5 MPa or more and 10 MPa or less when measured by the tensile testing method (JIS K 6301). The transfer belt can be rotated and driven while keeping sufficiently the shape of the belt, by using a member with Young's modulus of 0.5 MPa or more in the tensile testing of the transfer belt 24.

On the other hand, it becomes possible to effectively produce undulations on the recording medium P by the auxiliary separation device 40 described below, by using a member with 10 MPa or less capable of elastic deformation sufficiently, whereby more effective separation of the recording medium P from the transfer belt 24 can be fulfilled.

In addition, with a member capable of elastic deformation sufficiently, a relaxation phenomenon of the member is likely to occur, when an amount of deformation is decreased from a state where the member has been deformed. As a result, wear of the transfer belt 24 caused by the auxiliary separation device 40 can be reduced.

<Auxiliary Separation Device>

In the present exemplary embodiment, there is provided the auxiliary separation device 40 as a lifting means for locally lifting the transfer belt and causing it to be deformed in order to perform separation of the recording medium from the transfer belt. The auxiliary separation device 40 is provided on downstream side of the secondary transfer portion N in the recording medium conveying direction, on an inner surface side of the transfer belt 24 on upstream side of the stretching roller 26.

FIG. 2A, FIG. 2B, FIG. 2C, and FIG. 2D illustrate the detailed configuration and operation of the auxiliary separation device 40. The auxiliary separation device 40 includes an auxiliary separation roller 41 serving as an auxiliary separation member, and a roller frame 42 that rotatably supports the auxiliary separation roller 41.

Furthermore, the auxiliary separation device 40 includes a roller swing central shaft 43 which becomes a swing movement center of the auxiliary separation roller 41, a roller drive gear 44 which causes the auxiliary separation roller 41 to swingably move around a shaft 43, a motor driven transmission gear 45 for transmitting a driving force to the roller drive gear 44, and a motor 46 serving as a driving source.

The driving force from the motor 46 is transmitted to the roller drive gear 44 by the motor-driven transmission gear 45. Since a bearing is provided between the roller drive gear 44 and the roller swing central shaft 43, the roller swing central shaft 43 is designed not to be subjected to rotating and driving by the motor 46, so that its position may not move.

Figure 2A:
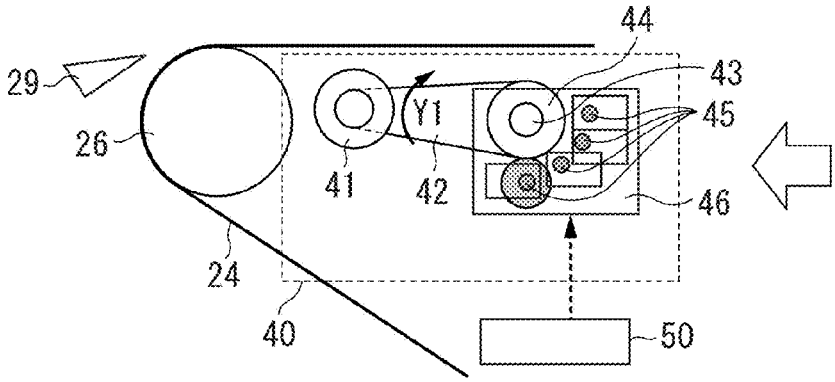
FIGS. 2A, 2B, 2C, and 2D illustrate a separation device and a transfer belt.
Figure 2B:
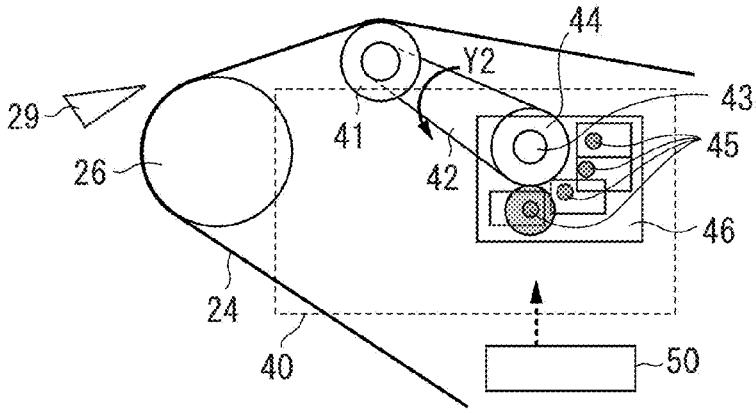

The auxiliary separation roller 41, and the roller frame 42 perform operation to move to a position where the roller 41 illustrated in FIG. 2B abuts against the inner surface of the transfer belt 24 in a Y1 direction from a roller retracting position illustrated in FIG. 2A, by a predetermined amount of forward rotation of the motor 46 around the roller swing central shaft 43.

Furthermore, the roller 41 illustrated in FIG. 2A can move from the belt lifting position to the retracting position separated from the transfer belt 24, in a Y2 direction from the belt lifting position in FIG. 2B, by a predetermined amount of reverse rotation of the motor 46. That is, the roller 41 is designed to perform such swing motion.

In a state in FIG. 2A (separated state), the distance from the auxiliary separation roller 41 to the transfer belt 24 is 6 mm. In the present exemplary embodiment, although setting is made to such distance as a distance which can surely prevent the contact between the auxiliary separation roller 41 and the transfer belt 24 during the separated state, the present invention is not limited to this value, as a matter of course.

In the state illustrated in FIG. 2B (lifting state), a lifting amount by which the auxiliary separation roller 41 lifts the belt surface of the transfer belt 24 from the inner surface side is set to 2 to 10 mm. In the present exemplary embodiment, although setting is made to such a distance as a spacing which can secure lifting of the belt surface of the transfer belt 24 during the lifting state, the present invention is not limited to this value, as a matter of course.

The lifting amount is based on a belt surface in a separated state. In the present exemplary embodiment, an amount of movement of the motor shaft is set based on a distance between the auxiliary separation roller 41 in the retracting position and the belt surface in the separated state, and the lifting amount. A desired lifting amount is realized in the present exemplary embodiment, by thus setting the amount of movement of the motor shaft.

A configuration for realizing a desired lifting amount is not limited to the configuration according to the present exemplary embodiment, and a configuration for providing a regulating member that regulates an amount of movement may be used. Alternatively, the amount of movement of the motor shaft may be set based on a size of an outside diameter of the auxiliary separation roller 41.

In the state illustrated in FIG. 2B, since the plurality of auxiliary separation rollers 41 lift locally the transfer belt 24, a step is formed between a portion lifted by the auxiliary separation roller 41 and a portion not lifted thereby. As a result, the surface of the transfer belt is undulated and deformed.

In the present exemplary embodiment, a configuration in which the auxiliary separation roller 41 is separated from the transfer belt 24, in the separated state. However, of course, a configuration may be used in which the auxiliary separation roller 41 is in contact with the transfer belt 24 to an extent a shape of the surface of the transfer belt is not affected.

In this case, "to an extent a shape of the transfer belt surface is not affected" means "to an extent irregularities caused by the auxiliary separation roller 41 do not appear, on the transfer belt, in a width direction of the transfer belt". More specifically, a maximum difference of the step needs to be within a range of 0.5 mm. "Width direction" means a direction orthogonal to the movement direction of the belt surface of the transfer belt 24.

The auxiliary separation roller 41 is made of etylene-propylene rubber (EPDM), and an outside diameter thereof is 8 mm, and a width in the width direction of the transfer belt is about 10 mm. Of course, the present invention is not limited to these numerical values. When such the auxiliary separation roller 41 lifts the transfer belt 24, local protrusions are formed on the transfer belt in the width direction of the transfer belt 24. It is desirable that the auxiliary separation roller 41 is made of rubber serving as an elastic member, in order to reduce wear of the inner surface of the transfer belt 24.

Figure 3:
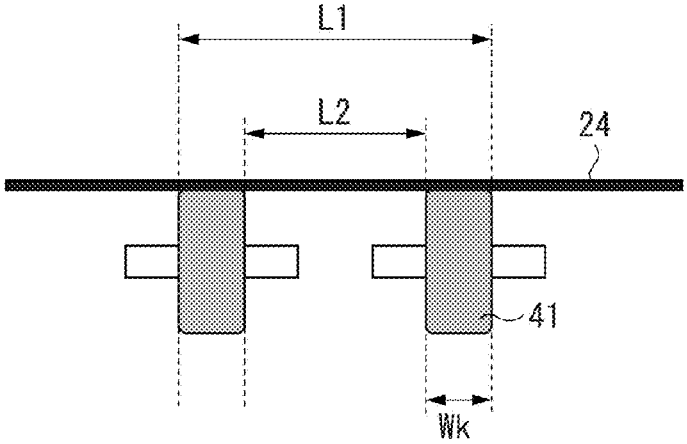
FIG. 3 illustrates the separation device.

FIG. 3 illustrates a width of the auxiliary separation roller 41 and a distance between the auxiliary separation rollers 41. In a case where a plurality of auxiliary separation rollers 41 are arranged, when the distance in the width direction of the auxiliary separation rollers 41 is arranged too narrow, the entire transfer belt will be lifted, and local protrusions will not be formed on the transfer belt 24. As a result, separability cannot be improved.

In order to form local protrusions, a certain width is needed. Thus, in the present exemplary embodiment, a width (10 mm) of the auxiliary separation roller 41, and a distance (35 mm) of the auxiliary separation rollers 41 are set. L1 denotes a length of a portion surrounded by roller front ends, and Wk denotes a width of the roller front end. L2 is a distance between opposed end surfaces of two adjacent rollers 41, which is obtained by L1−2 Wk.

In the present exemplary embodiment, L2 is set as 2 Wk or more, that is, a length of which the auxiliary separation roller 41 is not in contact with the transfer belt 24 becomes longer than a length of which the auxiliary separation roller 41 is in contact with the transfer belt 24. The transfer belt is locally deformed rather than lifted as a whole, and thus irregularities are likely to be formed on the transfer belt 24.

When a recording medium with a predetermined thickness is conveyed, local deformations are generated in the width direction of the transfer belt 24 due to lifting by the auxiliary separation roller 41. Since electric charge with a polarity opposite to that of a toner is provided to the inner surface of the transfer belt 24 by the transfer roller 9, the recording medium is in a state of being attracted to the transfer belt 24 due to the effect of the electrostatic transfer at least at the secondary transfer portion N.

Figure 6:
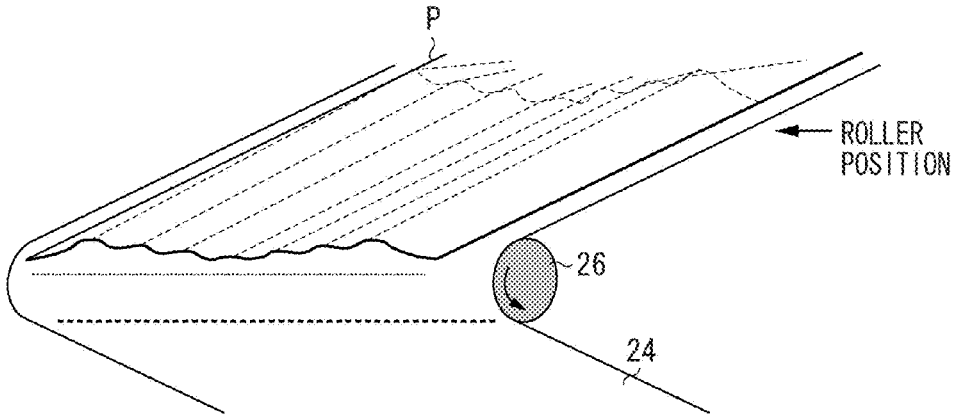
FIG. 6 illustrates the first exemplary embodiment.

Furthermore, a recording medium with a low stiffness is weak in firmness, and is easily deformed. For this reason, as illustrated in FIG. 6, undulations will be generated even on the recording medium along with deformations of the transfer belt 24. As a result, a moment of inertia of the cross section of the recording medium, that is, a firmness of the recording medium becomes greater. Accordingly, effective separation for separating an extremely thin recording medium with less firmness can be obtained.

Figure 2C:
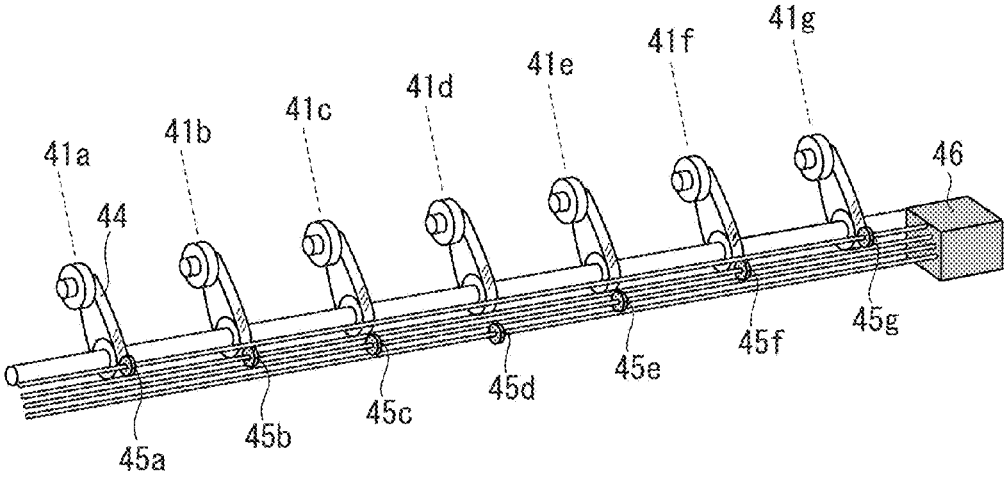

FIG. 2C is a perspective view illustrating the auxiliary separation device 40 according to the present exemplary embodiment. Seven auxiliary separation rollers 41 are arranged side by side at different positions in the width direction of the transfer belt 24. In the present exemplary embodiment, the seven auxiliary separation rollers 41*a*, 41*b*, 41*c*, 41*d*, 41*e*, 41*f*, and 41*g* are arranged in order from one end to the other in the width direction.

Positions in the width direction of the auxiliary separation rollers 41 are fixed, and the distance between opposed end surfaces of adjacent auxiliary separation rollers 41 is equal to 35 mm. Of course, it is not limited to this numerical value.

The auxiliary separation roller 41*d* is arranged to be positioned in the nearly central part of a recording medium which is conveyed in such a manner that the center in the width direction of the recording medium with any size of width substantially coincides with a common baseline. Then, the auxiliary separation rollers 41*a* and 41*g* at both ends are arranged in a passing region in the width direction of the recording medium with a predetermined maximum paper-passable size.

Here, "recording medium with a predetermined maximum paper-passable size" is a recording medium with a maximum width size that can be used for image formation by the apparatus, described in a specification manual of the image forming apparatus. If a size of the recording medium is large, even when the same undulations as those in a small size of the recording medium are generated, the weight of the recording medium itself also increases. As a result, the firmness of the recording medium will be decreased by being greatly affected by gravity.

For this reason, if a size of the recording medium is large, it is desirable to use a plurality of the auxiliary separation rollers 41. Since protruded portions of the auxiliary separation roller can be surely formed on the recording medium, by making a length between both ends of the auxiliary separation rollers shorter than the length in the width direction of the recording medium, it is necessary to have such a length relationship.

Figure 2D:
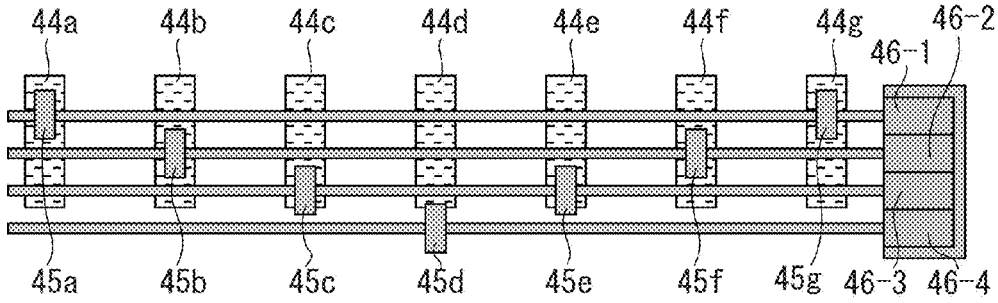

FIG. 2D illustrates a driving unit of the auxiliary separation roller device as viewed from an arrow direction in FIG. 2A. The roller drive gears 44*a*, 44*b*, 44*c*, 44*d*, 44*e*, 44*f*, and 44*g* swingably move each of the auxiliary separation rollers. The motor-driven transmission gears 45*a*, 45*b*, 45*c*, 45*d*, 45*e*, 45*f*, and 45*g* are used to transmit a driving force from the motor to each of the roller drive gears.

In the present exemplary embodiment, four sets of motors 46-1, 46-2, 46-3, and 46-4 are provided as driving sources. The driving force of the motor 46-1 is transmitted to each of the roller drive gears of the auxiliary separation rollers 41*a* and 41*g*, via the motor-driven transmission gears 45*a* and 45*g*. The driving force of the motor 46-2 is transmitted to each of the roller drive gears of the auxiliary separation rollers 41*b* and 41*f*, via the motor-driven transmission gear 45*b* and 45*f*.

The driving force of the motor 46-3 is transmitted to each of the roller drive gears of the auxiliary separation rollers 41*c* and 41*e*, via the motor-driven transmission gears 45*c* and 45*e*. The driving force of the motor 46-4 is transmitted to the roller drive gear of the auxiliary separation roller 41*d*, via the motor-driven transmission gear 45*d*. By employing such configuration, a distribution of lifting amounts can be set so that it becomes a symmetrical distribution with respect to the central part of the transfer belt. The lifting amount is measured using the belt surface in the separated state as a reference.

<Operation Control of Auxiliary Separation Device>

Figure 4:
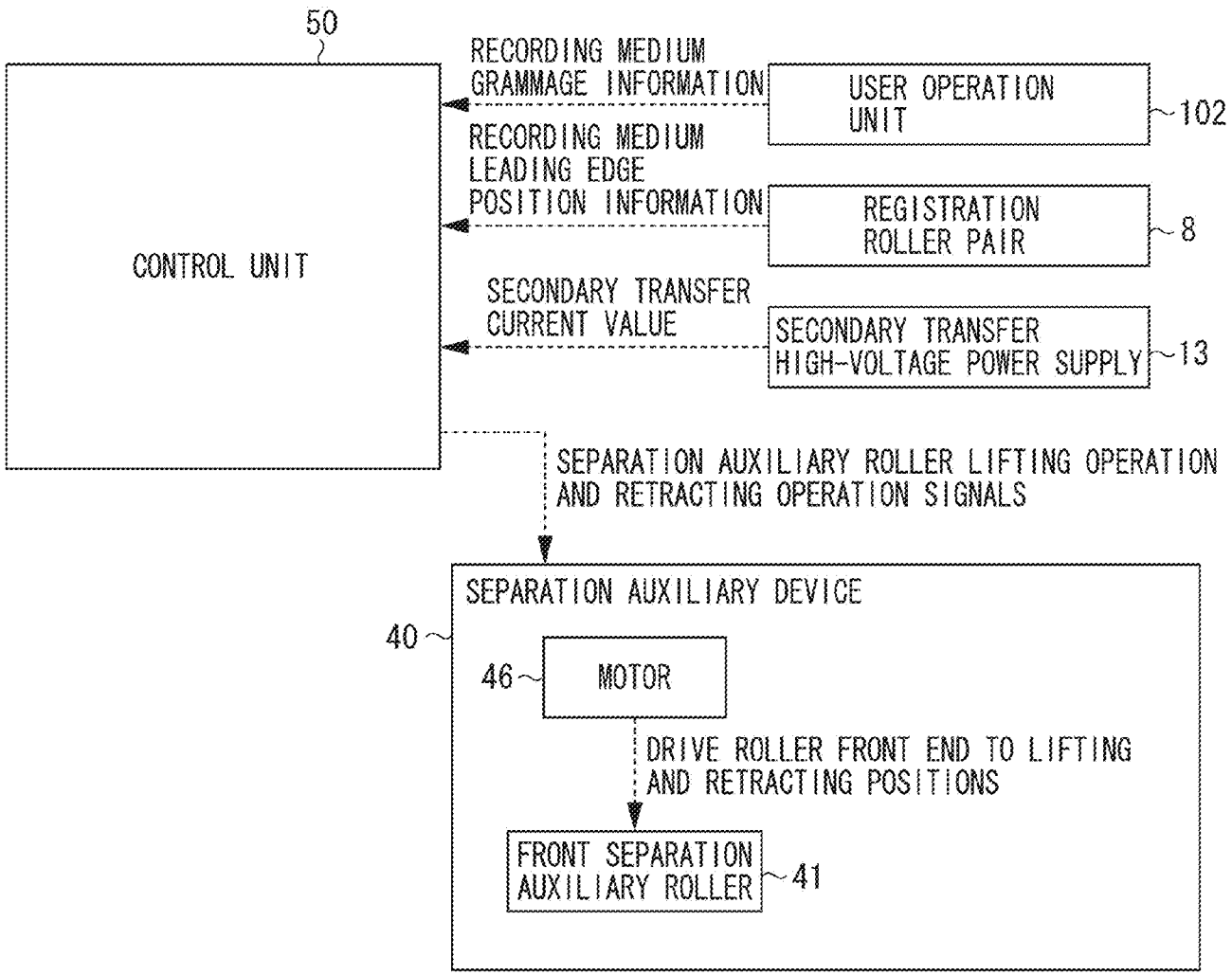
FIG. 4 illustrates the first exemplary embodiment.

Operational position of the auxiliary separation device 40 is controlled by the control unit 50. FIG. 4 illustrates a control relationship. The control of operational position signal of the auxiliary separation device 40 is performed based on recording medium grammage information designated by a user, recording medium leading edge position information acquired from a recording medium feeding timing of the registration roller pair 8, and secondary transfer current values read out by the secondary transfer high-voltage power supply 13.

The control unit 50 includes a central processing unit (CPU), a read-only memory (ROM), and a random-access memory (RAM). Information from the operation unit 102 through which the user operates the image forming unit is input into the control unit 50. Further, an operation timing of the registration roller 8 is input into the control unit 50. Also, information of the secondary transfer current values from the secondary transfer high-voltage power supply is input into the control unit 50. On the other hand, the control unit 50 controls an operation of the motor of the auxiliary separation device 40.

In the present exemplary embodiment, the following two patterns (deformed state, and separated state) are stored in the ROM in advance. The lifting amount of the auxiliary separation roller 41 in the deformed state will be described below in detail. If a grammage of the recording medium is equal to or smaller than 40 g/m$^2$, the auxiliary separation roller 41 is located at a lifting position to locally protrude the transfer belt 24 in the width direction (deformed state). If a grammage of the recording medium is equal to or greater than 40 g/m$^2$, the auxiliary separation roller 41 is located at a retracting position. In the retracting position, the auxiliary separation roller 41 is separated from the transfer belt 24 (separated state).

More specifically, the operation to lift the auxiliary separation roller 41 is performed with respect to a recording medium with a particular grammage (first grammage), and the operation to lift the auxiliary separation roller 41 is not performed with respect to a recording medium with a second grammage greater the first grammage.

A grammage of the recording medium will be described. A grammage is a weight of a recording medium per 1 $m^2$ (per unit area). The grammage is input into the image forming apparatus when the user inputs via the operation unit 102, or when the user inputs the grammage of the recording mediums accommodated in an accommodation unit that accommodates the recording mediums, into the image forming apparatus. The control unit 50 determines operation of the auxiliary separation device 40 according to information of the grammage input into the image forming apparatus. In the present exemplary embodiment, the grammage is used as a stiffness of the recording medium, but the thickness may be used as the stiffness thereof.

As the grammage becomes greater, the stiffness of the recording medium becomes higher, and as the grammage becomes smaller, the stiffness of the recording medium becomes lower. The stiffness of the recording medium may be associated with a thickness of the recording medium. In such a case, as the thickness of the recording medium becomes greater, the stiffness of the recording medium becomes higher. Conversely, as a thickness the recording medium becomes smaller, a stiffness of the recording medium becomes lower.

If the thickness of the recording medium is used in this way, a configuration may be used, in which a thickness detection member heretofore known, which detects a thickness of the recording medium, is provided on the upstream side of the registration roller in a conveying direction of the recording medium, and the control unit 50 controls operation of the auxiliary separation device 40 based on the output.

Figure 5:
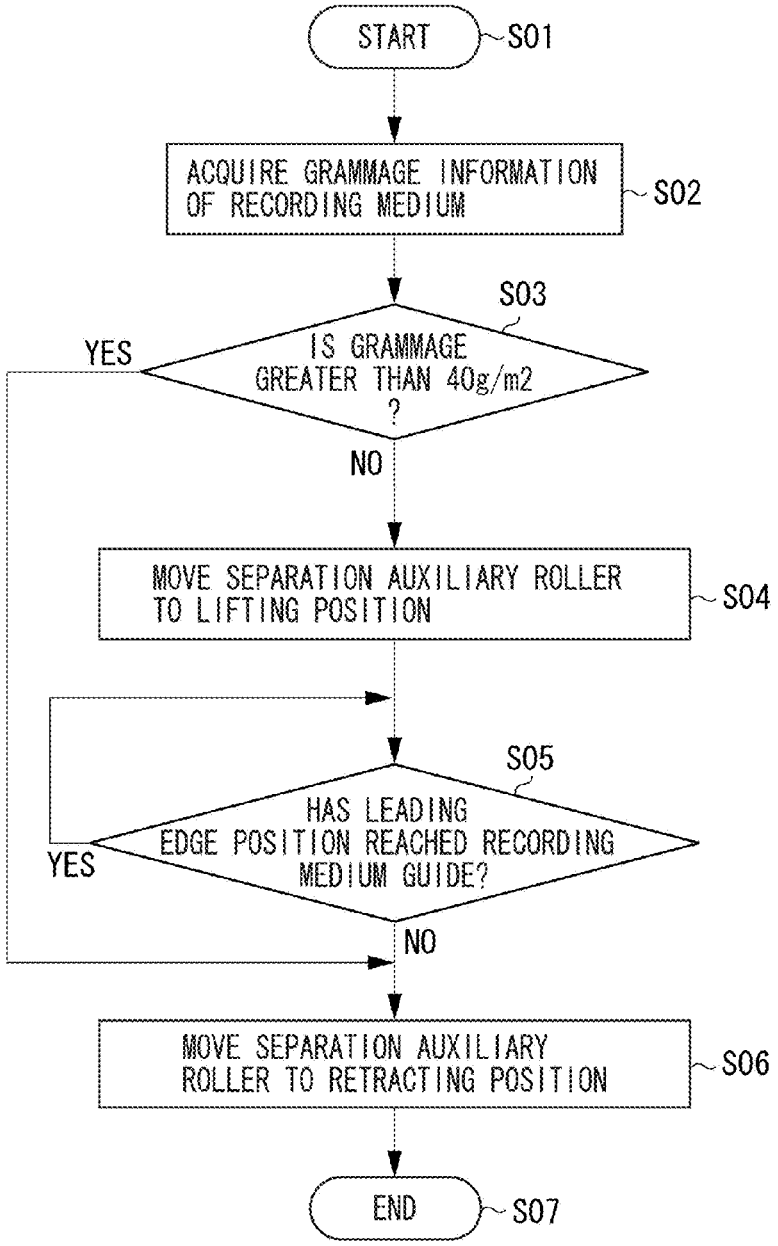
FIG. 5 is a flowchart illustrating the first exemplary embodiment.

Next, a flowchart according to which operation of the auxiliary separation device 40 is controlled, will be described with reference to FIG. 5. First, in step S01, as illustrated in FIG. 5, the processing starts by inputting an image formation signal. In step S02, the control unit 50 reads out information relating to the grammage of the recording medium to be used for image formation, that is, in the present exemplary embodiment, grammage information of the recording medium which the user has set via the user operation unit 102.

In step S03, the control unit 50 determines whether the read out grammage is greater than 40 g/$m^2$. If the control unit 50 has determined that the grammage of the recording medium is greater than 40 g/$m^2$ (YES in step S03), then in step S06, the control unit 50 arranges the auxiliary separation roller 41 at the retracting position. In step S07, the control unit 50 ends the processing.

If the grammage of the recording medium is equal to or smaller than 40 g/$m^2$ (NO in step S03), then in step S04, the control unit 50 performs operation to lift the transfer belt to form protrusions by the auxiliary separation device 40, for separating the recording medium from the transfer belt 24. The auxiliary separation roller 41 is moved in a Y1 direction, and is arranged at the lifting position at which the auxiliary separation roller 41 has lifted the transfer belt 24.

On the transfer belt deformed by the auxiliary separation roller 41, the recording medium P becomes greater in its firmness by the formation of undulations thereon, and is separated from the transfer belt before reaching the stretching roller 26.

Next, in step S05, the control unit 50 performs determination whether a leading edge of the recording medium has reached the recording medium guide 29. In the present exemplary embodiment, the recording medium guide 29 is configured to include a recording medium detection sensor (not illustrated), and determination whether the leading edge of the recording medium has reached the recording medium guide 29 is performed by the recording medium detection sensor. Of course, there may be used other methods such as a method for detecting a position of the recording medium by counting from a predetermined point, without providing the recording medium detection sensor on the recording medium guide 29.

If the recording medium has reached the recording medium guide 29 (YES in step S05), then in step S06, the control unit 50 determines that separation has been successfully performed, and causes the auxiliary separation roller 41 to move to the retracting position, and then in step S07, ends the processing. On the other hand, if the recording medium detection sensor has not detected the recording medium (NO in step S05), the control unit 50 determines that the recording medium has not reached the recording medium guide 29, and keeps lifting the auxiliary separation roller 41.

<Distribution of Lifting Amounts of Auxiliary Separation Roller>

In the present exemplary embodiment, lifting amounts of respective auxiliary separation rollers 41 in the "deformed" state are stored in advance in the control unit 50. In the present exemplary embodiment, in the "deformed" state, the lifting amounts of the auxiliary separation rollers 41*a* and 41*g* are 10 mm, the lifting amounts of the auxiliary separation rollers 41*b* and 41*f* are 8 mm, the lifting amounts of the auxiliary separation rollers 41*c* and 41*e* are 6 mm, and the lifting amount of the auxiliary separation roller 41*d* is 4 mm. Here, "lifting amount" refers to an upward change amount in a direction perpendicular to the transfer belt surface in the "separated" state.

The lifting amounts of the respective auxiliary separation rollers 41 are set by controlling rotating and driving amount of the motor for driving the respective auxiliary separation rollers 41. Heights of protrusions formed on the transfer belt 24 are in the same level as the lifting amounts of the auxiliary separation rollers.

A plurality of protrusions are formed on the transfer belt by the lifting the auxiliary separation rollers. The heights of protrusions corresponding to the auxiliary separation rollers 41*a*, 41*b*, 41*c*, 41*d*, 41*e*, and 41*f* are about 10 mm, 8 mm, 6 mm, 4 mm, 6 mm, 8 mm, and 10 mm. The differences of heights between the adjacent protrusions are thus uniformly equal to 2 mm.

In this way, the "deformed" state is in a mode (first mode), for forming, next to a protrusion of a first height (first protrusion), a second protrusion higher than the first height.

FIG. 6 is a perspective view illustrating the transfer belt in the "deformed" state according to the present exemplary embodiment. The lifting amounts of the auxiliary separation rollers 41 adjacent to each other in the width direction are set to be different from each other.

Figure 9A:
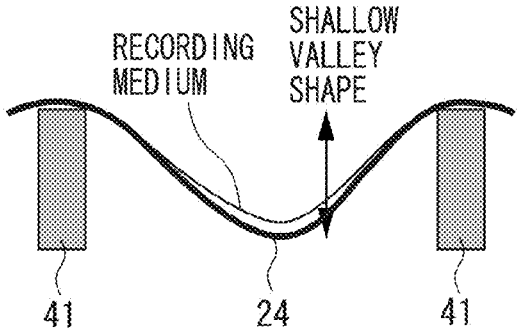
FIGS. 9A, 9B, and 9C illustrate undulations formed on the transfer belt by the separation device.

The reason will be described with reference to FIGS. 9A, 9B, and 9C. These figures illustrate cross-sections perpendicular to the conveying direction of the recording medium, when the auxiliary separation rollers lift the transfer belt. FIG. 9A illustrates a case where protrusions formed on the transfer belt 24 are low (about 2 mm). In this case, a valley shape formed between adjacent protrusions is shallow. For this reason, in a bottom of the valley shape, the recording medium is in contact with the transfer belt, or even if the recording medium is not in contact therewith, the gap formed between the bottom and the recording medium is small.

Figure 9B:
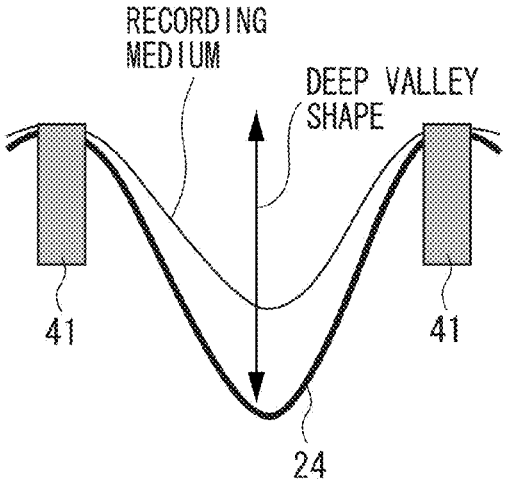

However, FIG. 9B illustrates a case where protrusions formed on the transfer belt 24 are made high, in order to increase the firmness to be imparted to the recording medium to a high level. In this case, a valley shape formed between adjacent protrusions becomes deep and steep. In a bottom of the valley shape, the recording medium becomes floated, and the gap between the recording medium and the valley shape becomes large. As a result, electric discharge may occur at the gap, and there may be a risk that the toner image may be deteriorated.

Figure 9C:
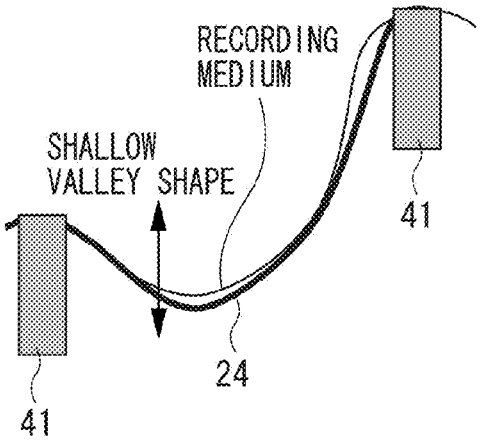

FIG. 9C illustrates a case where the lifting amounts are made high so that the lifting amounts of adjacent auxiliary separation rollers 41 differ from each other. In this case, a protrusion (second protrusion) of a second height higher than the first height is formed, next to a protrusion (first protrusion) having the first height.

A valley portion of the transfer belt formed between protrusions is maintained shallow. As a result, even if the firmness to be imparted to the recording medium is increased to a high level, the formed valley shape can be restrained from becoming deep by the lifting of the auxiliary separation rollers 41.

In the present exemplary embodiment, as illustrated in FIG. 9C, a mode is executable for forming the second protrusion higher than the first height, next to a protrusion of the first height. Even when the lifting amount of the transfer belt is increased in a configuration for performing separation of the recording medium from the transfer belt by forming plural protrusions by locally lifting the transfer belt, a valley shape of the transfer belt formed between the adjacent protrusions can be inhibited from becoming deep, while keeping short a spacing between adjacent protrusions.

Further, in the present exemplary embodiment, by setting lifting amounts at end portions in the width direction greater than a lifting amount in the center, the end portions in the width direction of the recording medium are supported by the lifting, and the end portions in the width direction of the recording medium are restrained from being hung and caught in the recording medium guide 29.

For the parts duplicating the first exemplary embodiment, descriptions thereof will be omitted since they are similar to those of the first exemplary embodiment. If materials of recording media are different, resistance values of the recording media themselves are different, even when the recording media have the same grammage. As a result, if a secondary transfer bias is constant-voltage-controlled, a situation occurs that secondary transfer current values, which actually flow when the recording media pass through a secondary transfer nip, do not become the same, even when the recording mediums have the same grammage.

As the secondary transfer current increases, which flows when the recording medium passes through the secondary transfer nip, the electrostatic attracting force between the recording medium and the transfer belt 24 becomes strong, and thus separability seems to become worse. Thus, the effect of the secondary transfer current on the separability of the recording medium from the transfer belt 24 was studied. As the result of the study, it was found that, when the secondary transfer current value becomes greater than 40 μA, it becomes difficult to separate a recording medium with a grammage greater than 40 g/m$^2$ and smaller than 60 g/m$^2$ from the transfer belt 24 by the stretching roller 26.

Thus, in the present exemplary embodiment, after providing the transfer current detection unit that detects transfer electric current values, operation control of the auxiliary separation device 40 is determined on the basis of a transfer current value detected by the transfer current detection unit when the leading edge of the recording medium passes through the secondary transfer nip. More specifically, in the present exemplary embodiment, operational position control of the auxiliary separation device 40 is performed according to the flow illustrated in FIG. 8, based on matrix illustrated in Table 1.

TABLE 1

| | | Grammage of Paper P | | |
|---|---|---|---|---|
| | | 40 g/m2 or less | 40 to 60 g/m2 | 60 g/m2 or more |
| Secondary Transfer Currentnt | 40 μA or more | deformation 1 | deformation 3 | separation |
| | 40 μA or less | deformation 2 | separation | separation |

Table 1 is a table stored in advance in a storage unit provided within the control unit 50. This control table is used to separate a case where the transfer belt 24 is deformed by the auxiliary separation roller 41 (deformation), from a case where the auxiliary separation roller 41 is separated from the transfer belt 24 (separation), according to the grammage of the recording medium, and the transfer current value when a leading edge of the recording medium passes through the transfer nip. In a case where the grammage is 40 g/m$^2$ or less and the secondary transfer current is 40 μA or more, the "deformation 1" state is selected.

In a case where the grammage is 40 g/m$^2$ or less and the secondary transfer current is 40 μA or less, the "deformation 2" state is selected. In a case where a grammage is 40 to 60 g/m$^2$ and a secondary transfer current is 40 μA or more, the "deformation 3" state is selected. In a case where the grammage is 40 to 60 g/m$^2$ and a secondary transfer current is 40 μA or less, and a case where a grammage is 60 g/m$^2$ or more, the "separation" state is selected. The "deformation 1", "deformation 2", and "deformation 3" states will be described in detail below.

Figure 8A:
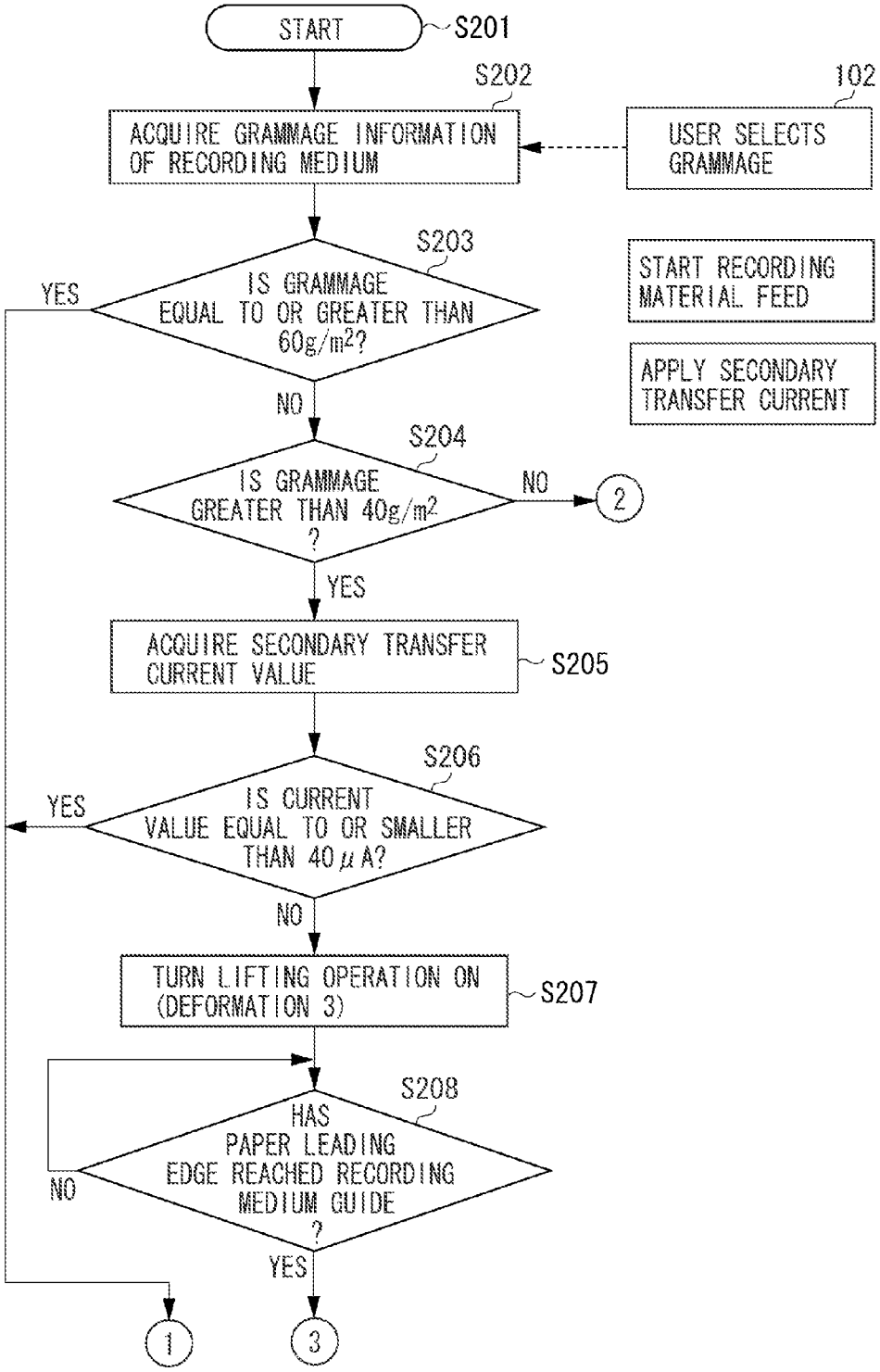
FIGS. 8 (8A and 8B) is a flowchart according to the second exemplary embodiment.
Figure 8B:
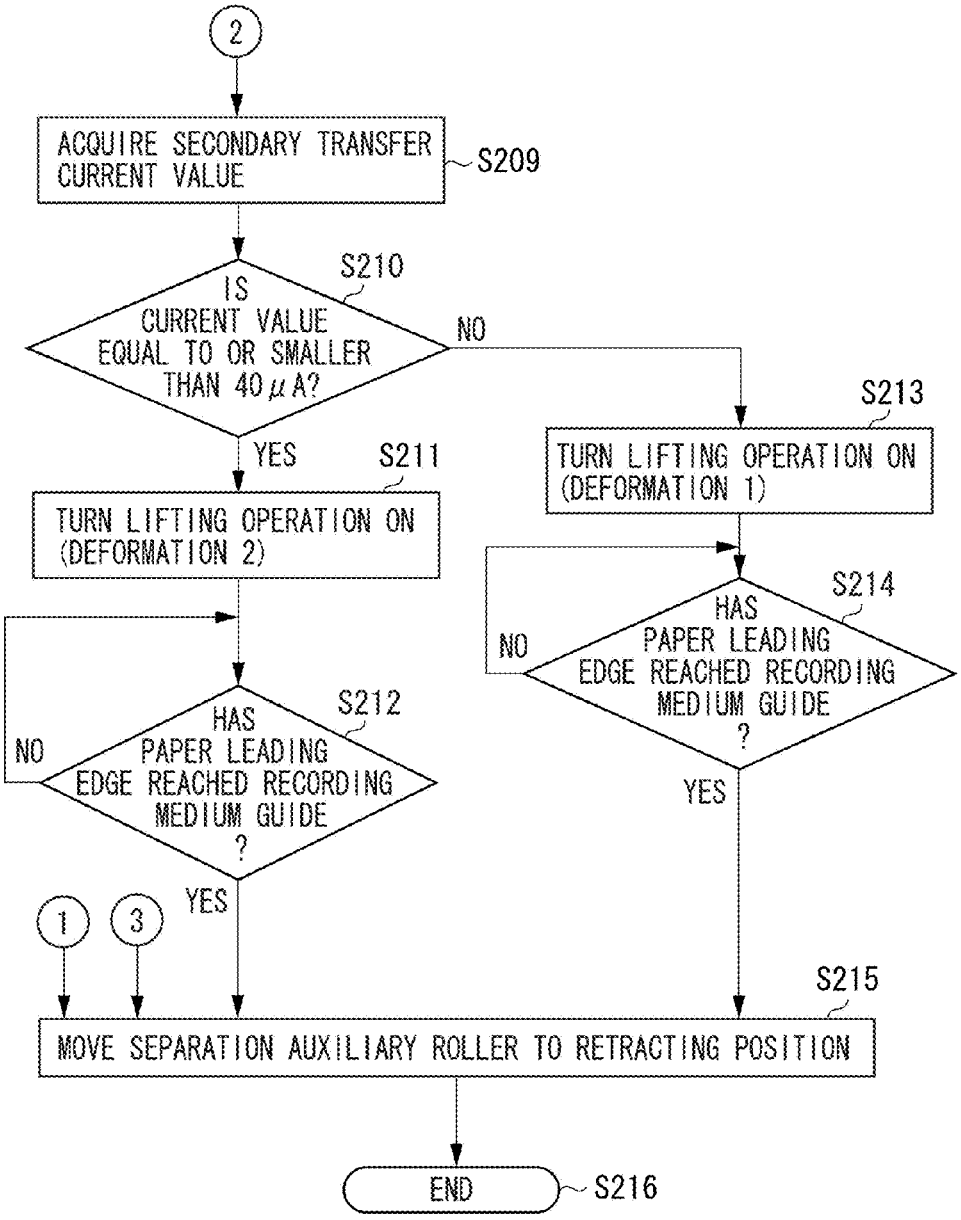

Next, an operation control flowchart of the auxiliary separation roller 41 according to the second exemplary embodiment will be described with reference to FIG. 8.

In step S201, the processing starts. In step S202, the control unit 50 acquires information of the grammage information of a recording medium (paper). In step S203, the control unit 50 determines whether the grammage of the recording medium is 60 g/m$^2$ or more. If it is determined that the grammage is 60 g/m$^2$ or more (YES in step S203), then in step S215, the control unit 50 arranges the auxiliary separation roller 41 to the retracting position, and in step S216, ends the processing. When the grammage is 60 g/m$^2$ or mores, separation of the recording medium is performed by the separation stretching roller 26.

On the other hand, if the grammage is smaller than 60 g/m$^2$, it is necessary to perform lifting operation to increase the firmness of the recording medium to a high level for separating the recording medium. In step S203, if it is determined that the grammage is less than 60 g/m$^2$ (NO in step S203), then in step S204, it is determined whether the grammage is greater than 40 g/m$^2$. This is because the deformation state to be set is changed depending on the grammage.

In step S204, if it is determined that the grammage is greater than 40 g/m$^2$ (YES in step S204), then in step S205, the control unit 50 acquires the secondary transfer current. In step S206, it is determined whether the secondary transfer current is equal to or smaller than 40 μA. This is because the higher the secondary transfer current is, the stronger the electrostatic attracting force between the recording medium and the transfer belt 24 becomes, and it becomes difficult for the recording medium to be separated from the transfer belt 24.

If the secondary transfer current is equal to or smaller than 40 μA (YES in step S206), then in step S215, the control unit 50 arranges the auxiliary separation roller 41 to the retracting position, and in step S216, ends the processing. If it is determined that the secondary transfer current is greater than 40 μA (NO in step S206), then in step S207, the control unit 50 performs the lifting operation to bring the auxiliary separation roller 41 into the "deformation 3" state. The recording medium is separated from the transfer belt 24 by the lifting operation.

In step S208, if it is determined that the leading edge of the recording medium has reached the recording medium guide (YES in step S208), then in step S215, the control unit 50 moves the auxiliary separation roller 41 to the retracting position, and in step S216, ends the processing.

In step S204, if it is determined that the grammage is not greater than 40 g/m$^2$ (NO in step S204), then in step S209, the control unit 50 acquires the secondary transfer current. In step S210, it is determined whether the transfer electric current value is equal to or smaller than 40 μA.

If it is determined that the transfer current value is equal to or smaller than 40 μA (YES in step S210), then in step S211, the control unit 50 performs the lifting operation to bring the auxiliary separation roller 41 into the "deformation 2" state. The recording medium is separated from the transfer belt 24 by the lifting operation. If it is determined that the recording medium has reached the recording medium guide (YES in step S212), then in step S215, the control unit 50 moves the auxiliary separation roller 41 to the retracting position, and in step S216, ends the processing.

If it is determined that the transfer current value is greater than 40 μA (NO in step S210), then in step S213, the control unit 50 performs the lifting operation to bring the auxiliary separation roller 41 into the "deformation 1" state. The recording medium is separated from the transfer belt 24.

If it is determined that the leading edge of the recording medium has reached the recording medium guide (YES in step S214), then in step S215, the control unit 50 moves the auxiliary separation roller 41 to the retracting position, then in step S216, ends the processing.

<Timing of Operation Control of Auxiliary Separation Roller>

Figure 10:
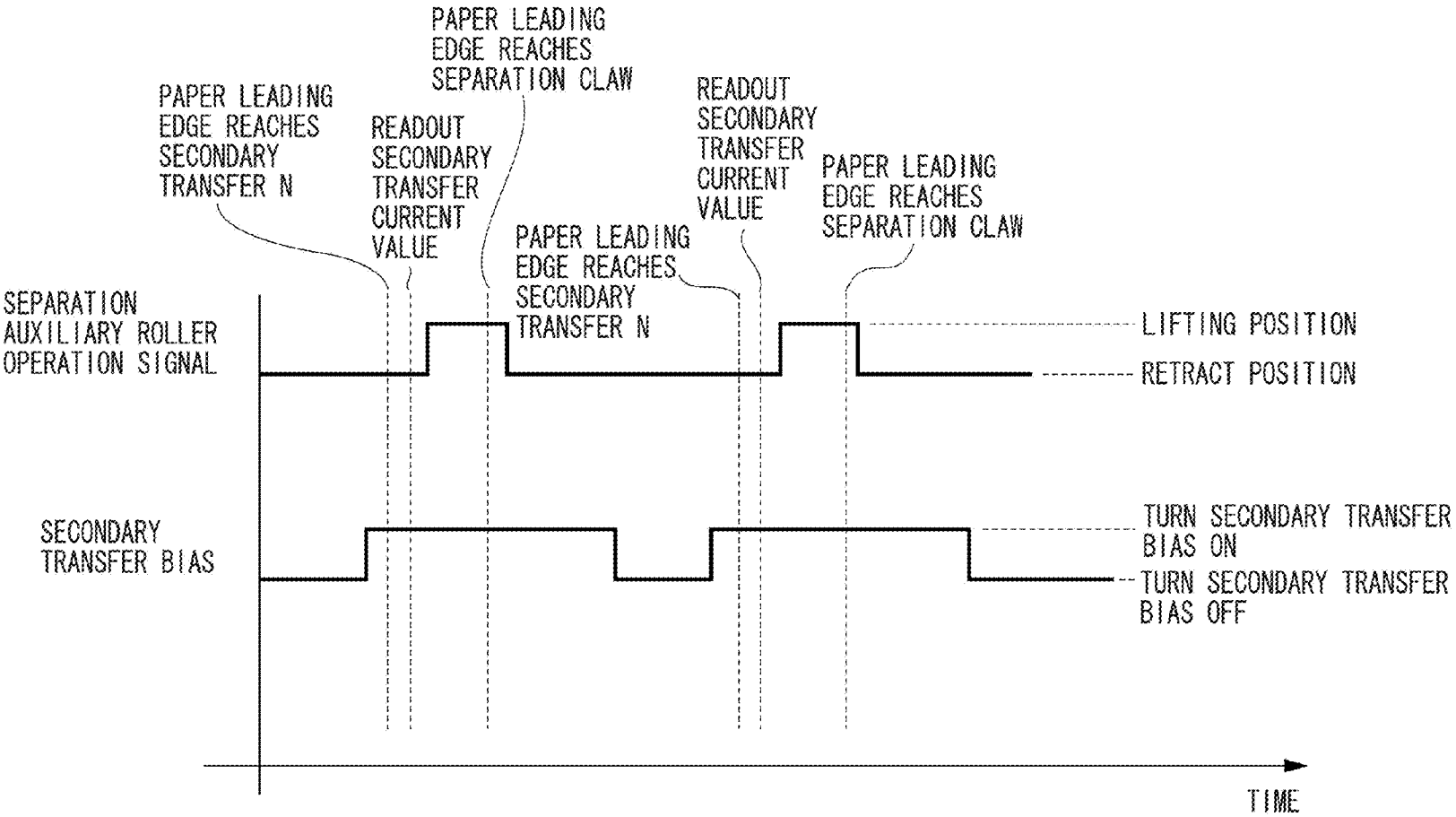
FIG. 10 illustrates a timing chart according to the second exemplary embodiment.

The timing at which the auxiliary separation roller is controlled in a case where the grammage is greater than 40 g/m$^2$ and smaller than 60 g/m$^2$, and the secondary transfer current value is equal to or greater than 40 μA, will be described with reference to FIG. 10.

When a constant-voltage-controlled secondary transfer bias is applied (ON), and the leading edge of the recording medium reaches the secondary transfer nip, the secondary transfer current is read by the transfer current detection member. If the secondary transfer current value read after the leading edge of the recording medium has reached the secondary transfer nip is equal to or greater than 40 μA, an auxiliary separation roller operation signal for moving the auxiliary separation roller 41 to the lifting position is transmitted from the control unit 50 to the auxiliary separation roller 41.

Thereafter, when it is determined that the leading edge of the recording medium has reached the guide surface of the recording medium guide 29, the auxiliary separation roller operation signal for moving the auxiliary separation roller 41 to the retracting position is transmitted from the control unit 50 to the auxiliary separation roller 41.

<Distribution of Lifting Amounts of Auxiliary Separation Roller>

In the present exemplary embodiment, as illustrated in Table 2, in a case where the grammage is 40 g/m$^2$ or less and a secondary transfer current is 40 μA or more, the auxiliary separation roller 41 is put into the "deformation 1" state. In a case where the grammage is 40 g/m$^2$ or less and a secondary transfer current is 40 μA or less, the auxiliary separation roller 41 is put into the "deformation 2" state.

In a case where the grammage is 40 to 60 g/m$^2$ and the secondary transfer current is 40 μA or more, the auxiliary separation roller 41 is put into the "deformation 3" state. For this reason, even when the auxiliary separation roller 41 lifts the transfer belt in order to secure the separability of the recording medium, the excess load exerted on the transfer belt can be reduced by the auxiliary separation roller 41.

First, the case where it is most difficult for the recording medium to be separated among three cases is the case where the grammage is 40 g/m$^2$ or less and the secondary transfer current is 40 μA or more. Thus, in the "deformation 1" state, the lifting amounts of the auxiliary separation rollers 41*a* and 41*g* are set to 10 mm, the lifting amounts of the auxiliary separation rollers 41*b* and 41*f* are set to 8 mm, the lifting amounts of the auxiliary separation rollers 41*c* and 41*e* are set to 6 mm, and the lifting amount of the auxiliary separation roller 41*d* is set to 4 mm.

The heights of protrusions corresponding to the separations auxiliary rollers 41*a*, 41*b*, 41*c*, 41*d*, 41*e*, and 41*f* are about 10 mm, 8 mm, 6 mm, 4 mm, 6 mm, 8 mm, and 10 mm. This is the same setting as the "deformation" state in the first exemplary embodiment as illustrated in FIG. 6. Since the lifting amount is large, and a valley-like shape is formed as a whole, the effect of increasing the firmness of the recording medium is large.

In addition, since the distribution of lifting amounts is set so that the lifting amounts of adjacent auxiliary separation rollers 41 differ from each other, the valley shape of the transfer belt formed between protrusions can be restrained from becoming deep and steep, even when the firmness to be imparted to the recording medium is increased.

The second highest firmness is required to secure the separability of the recording medium, in the case, among three cases, where the grammage is 40 g/m$^2$ or less and the secondary transfer current is 40 μA or less. Thus, in the "deformation 2" state, the lifting amounts of the auxiliary separation rollers 41*a* and 41*g* are set to 8 mm, the lifting amounts of the auxiliary separation rollers 41*b* and 41*f* are set to 6 mm, the lifting amounts of the auxiliary separation rollers 41*c* and 41*e* are set to 4 mm, and the lifting amount of the auxiliary separation roller 41*d* is set to 2 mm.

The heights of protrusions corresponding to the auxiliary separation rollers 41*a*, 41*b*, 41*c*, 41*d*, 41*e*, and 41*f* are about 8 mm, 6 mm, 4 mm, 2 mm, 4 mm, 6 mm, and 8 mm. Since lifting amounts are set smaller than those in the "deformation 1" state, excess lifting can be reduced.

On the other hand, the separability of the recording medium is secured by forming the valley-like shape as a whole. Also, the distribution of the lifting amounts is set so that the lifting amounts of adjacent auxiliary separation rollers 41 differ from each other. As a result, even when the firmness to be imparted to the recording medium is increased, the valley shape of the transfer belt formed between protrusions can be restrained from becoming deep and steep.

The case where it is next most difficult for the recording medium to be separated among the three cases is the case where the grammage is 40 to 60 g/m$^2$ and the secondary transfer current is 40 μA or more. In the "deformation 3" state, the lifting amounts of the auxiliary separation rollers 41*a* to 41*f* are uniformly set to 2 mm.

Figure 7:
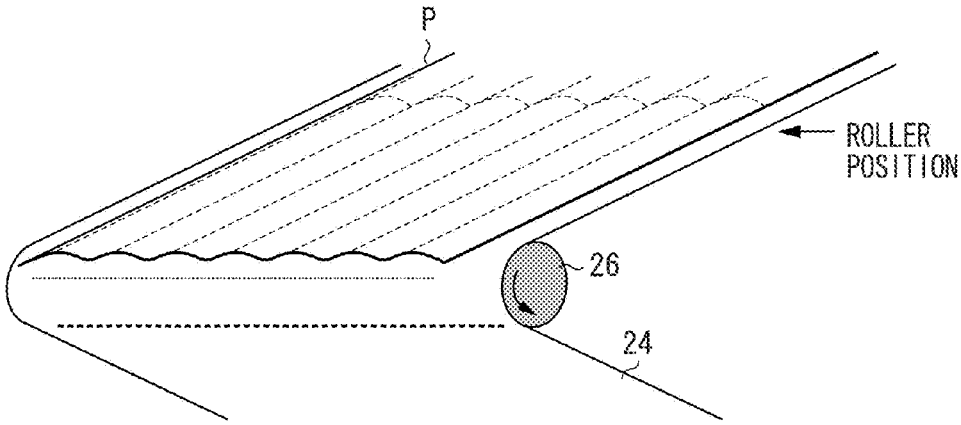
FIG. 7 illustrates a second exemplary embodiment.

FIG. 7 is a perspective view illustrating the "deformation 3" state. The lifting amounts are made smaller than those in the "deformation 2" state, and excess lifting is reduced. In addition, since the lifting amounts are small, the valley shape of the transfer belt 24 formed between adjacent protrusions does not become deep. Therefore, protrusions are not formed so that adjacent heights thereof differ from each other.

For the parts similar to the first exemplary embodiment, descriptions thereof will be omitted. The part in which the present exemplary embodiment differs from the first exemplary embodiment is a lifting distribution of respective auxiliary separation rollers 41 when the transfer belt 24 is deformed by the auxiliary separation roller 41 (deformed).

Figure 11:
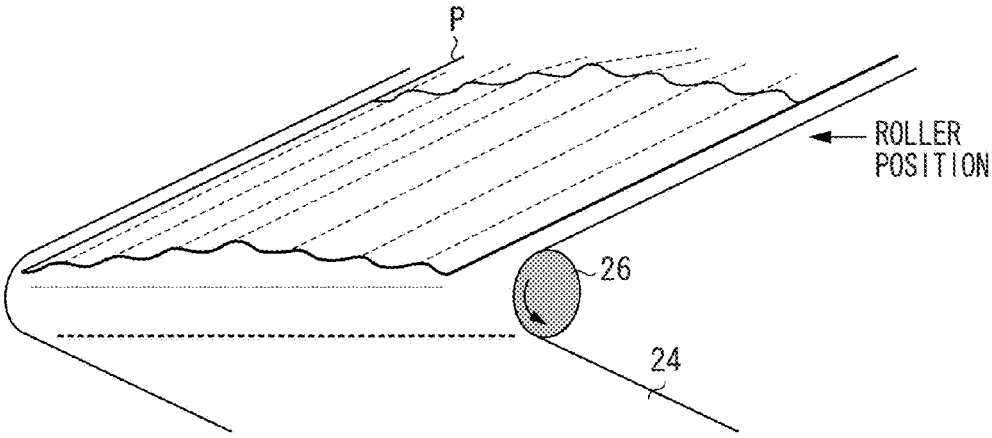
FIG. 11 illustrates a third exemplary embodiment.

In the "deformation" state according to the present exemplary embodiment, the lifting amounts of the auxiliary separation rollers 41*a* and 41*g* are set to 4 mm, the lifting amounts of the auxiliary separation rollers 41*b* and 41*f* are set to 6 mm, the lifting amounts of the auxiliary separation rollers 41*c* and 41*e* are set to 8 mm, and the lifting amount of the auxiliary separation roller 41*d* is set to 10 mm. The heights of protrusions corresponding to the auxiliary separation rollers 41*a*, 41*b*, 41*c*, 41*d*, 41*e*, and 41*f* are about 4 mm, 6 mm, 8 mm, 10 mm, 8 mm, 6 mm, and 4 mm FIG. 11 is a perspective view illustrating the transfer belt in the deformation state in the present exemplary embodiment. Since the distribution of lifting amounts is set so that the lifting amounts of adjacent auxiliary separation rollers 41 differ from each other, even when the firmness to be imparted to the recording medium is increased, the valley shape of the transfer belt formed between protrusions can be restrained from becoming deep and steep.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-136309 filed Jun. 15, 2010, which is hereby incorporated by reference herein in its entirety.

What is claimed is:

1. An image forming apparatus comprising:

an image bearing member configured to bear a toner image;

a movable belt member configured to bear and convey a recording material;

a transfer member configured to electrostatically transfer the toner image formed on the image bearing member onto the recording material borne and conveyed by the belt member;

a plurality of push-up members configured to be disposed so that each of the push-up members is aligned in the a width direction across a moving direction of the belt member, and configured to push up, from an inner side, the belt member on a downstream side of the transfer member in the conveying direction of the recording material so that the belt member is deformed to have a first protruded portion and a second protruded portion which is disposed in a position adjacent to the first protruded portion in the width direction; and an execution unit configured to be capable of executing a mode for separating the recording material by using the push-up members, in the mode a first height of the belt member in the first protruded portion being lower than a second height of the belt member in the second protruded portion in a direction perpendicular to the belt surface.

2. The image forming apparatus according to claim 1, wherein, when the mode is a first mode, the execution unit is able to execute a second mode for separating the recording material by using the push-up members, in the second mode each of a height of the belt member in a plurality of protruded portions at different positions in the width direction is uniform and the height is equal to or smaller than the first height.

3. The image forming apparatus according to claim 2, wherein, when a recording material with a first thickness is conveyed by the belt member, the execution unit executes the first mode, and when a recording material having a second thickness thicker than the first thickness is conveyed, the execution unit executes the second mode.

4. The image forming apparatus according to claim 1, wherein, in the mode, a belt member is deformed so that differences in height of the belt member in each adjacent protruded portion become uniform.

5. The image forming apparatus according to claim 1, wherein the plurality of push-up members push up the transfer belt so that the closer to an each edge of the belt member in the width direction the belt member becomes, the greater the height of the protruded portion becomes.

6. An image forming apparatus comprising:

an image bearing member configured to bear a toner image;

a movable belt member configured to bear and convey a recording material;

a transfer member configured to electrostatically transfer the toner image formed on the image bearing member onto the recording material borne and conveyed by the belt member;

a plurality of push-up members, including a first push-up member and a second push-up member which is disposed in a position adjacent to the first push-up member in the a width direction across a moving direction of the belt member, configured to be disposed on a downstream side of the transfer member in the conveying direction of the recording material so that both the first push-up member and the second push-up member push up, from an inner side, the belt member in a state that a height of the first push-up member is lower than a height of the second push-up member in a direction perpendicular to the belt surface.

* * * * *